United States Patent [19]

Nestor

[11] Patent Number: 4,531,804

[45] Date of Patent: Jul. 30, 1985

[54] INSULATION SHEARING ELECTRICAL TERMINAL

[75] Inventor: Charles R. Nestor, Niles, Ohio

[73] Assignee: General Motors Corporation, Detroit, Mich.

[21] Appl. No.: 498,402

[22] Filed: May 26, 1983

[51] Int. Cl.[3] ..... H01R 11/20

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,380,013 | 4/1968 | Krone et al. | 339/97 |
| 3,805,214 | 4/1974 | Demler, Sr. et al. | 339/97 R X |
| 3,824,530 | 7/1974 | Roberts et al. | 339/99 R |
| 3,835,444 | 9/1974 | Plana et al. | 339/98 |
| 4,060,302 | 11/1977 | Saligny | 339/97 R |
| 4,097,107 | 6/1978 | Hawkins | 339/97 R |
| 4,118,096 | 10/1978 | Takahashi | 339/99 R |
| 4,220,390 | 9/1980 | Cobaugh et al. | 339/97 R |
| 4,448,477 | 5/1984 | Gladd et al. | 339/217 S X |

FOREIGN PATENT DOCUMENTS

| | | | |
|---|---|---|---|
| 1259992 | 2/1968 | Fed. Rep. of Germany | 339/97 R |
| 2075279 | 11/1981 | United Kingdom . | |
| 2112216 | 6/1983 | United Kingdom . | |

*Primary Examiner*—Gil Weidenfeld
*Assistant Examiner*—Steven C. Bishop
*Attorney, Agent, or Firm*—F. J. Fodale

[57] ABSTRACT

An insulation shearing electrical terminal for terminating an insulated conductor comprises an elongated web depending from a resilient socket. The web has an integral flange which is folded over onto itself to form outer and inner elongated plates which are integrally joined to each other at one end of the flange by a longitudinal bight which is laterally spaced from the web. The outer plate has a longitudinal slot at the opposite end of the flange which receives an insulated conductor with its axis transverse to the longitudinal slot. The inner plate has opposite longitudinal sides at the opposite end of the flange which respectively engage the web and the insulated conductor to produce a shearing action of the plates across the diameter of the insulated conductor.

2 Claims, 7 Drawing Figures

INSULATION SHEARING ELECTRICAL TERMINAL

This invention relates to electrical terminals and more particularly to insulation shearing electrical terminals.

It is well known to provide insulation shearing electrical terminals which have a narrow fixed slot for attaching the terminal to an insulated conductor. Such terminals are attached by pushing the insulated conductor transverse to its axis into the narrow fixed slot so that the sides of the slot shear the insulation and establish electrical contact with the conductive core.

Insulation shearing electrical terminals of the fixed slot type have some well known drawbacks. The width of the fixed slot is often critical and in some instances the sides of the fixed slot may require special treatment, such as coining and/or plating. The fixed slot may widen after extended use due to metal relaxation resulting in a poor electrical interface with the conductive core. The fixed slot is often not suitable for use with insulated conductors having a multistranded conductive core which may change size and shape during use.

A known solution to these well known drawbacks is to provide an insulation shearing electrical terminal having a variable slot, such as is disclosed in the U.S. Pat. No. 4,097,107 granted to Harold G. Hawkins on June 27, 1978. In this prior art terminal, the variable slot is provided by two juxtaposed slotted plates which are connected by a hairpin shaped spring.

The object of this invention is to provide an improved insulation shearing electrical terminal of the variable slot type.

Another object of this invention is to provide an insulation shearing electrical terminal of the variable slot type which is very narrow so that the electrical terminals can be placed side-by-side on close centerlines.

Yet another object of this invention is to provide an insulation shearing electrical terminal of the variable slot type in which the plate members are elongated and connected by a longitudinal bight at one end so as to produce a shearing action within a very narrow space.

These and other objects and features of the invention will be readily apparent from the following specification and drawings wherein.

Figure 1:
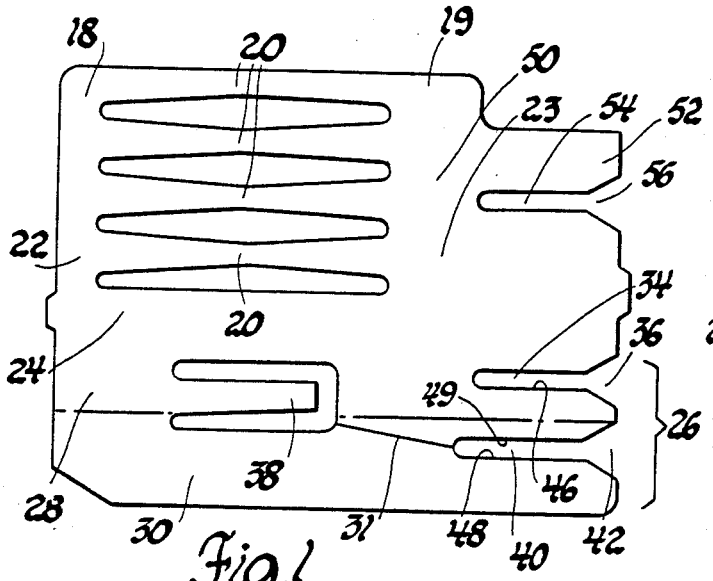
FIG. 1 is a plan view of a blank for making an electrical terminal in accordance with this invention.

Referring now to the drawing, FIG. 1 shows a stamped sheet metal blank for making an electrical terminal 10 of this invention which is shown in FIGS. 2 through 7. The electrical terminal 10 comprises a resilient socket 12 designed to receive a contact pin (not shown) and means designated generally at 14 for attaching the terminal 10 to an insulated conductor 16.

The resilient socket 12 is generally of the type disclosed in U.S. patent application Ser. No. 359,686 filed by Joseph H. Gladd et al on Mar. 19, 1982, now U.S. Pat. No. 4,448,477, and assigned to the assignee of this invention. It comprises a pair of longitudinally spaced, square end bands 18, 19 which are connected by four spring tongues 20. The corresponding sides 22, 23 at the open corners of the square end bands 18, 19 are joined by a coplanar elongated web 24 which extends outwardly of the resilient socket 12.

Figure 2:
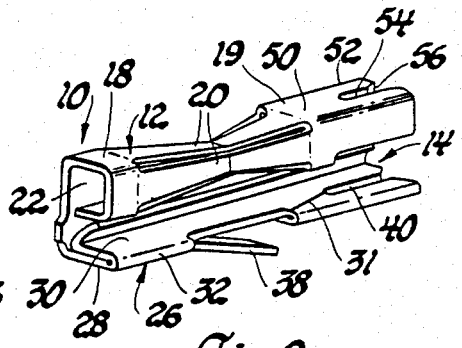
FIG. 2 is a perspective view of an electrical terminal in accordance with this invention.
Figure 4:
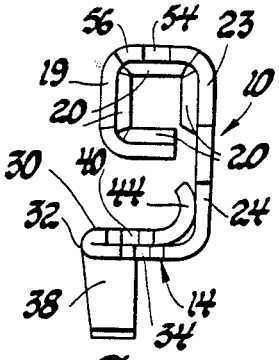
FIG. 4 is a rear view of the electrical terminal taken substantially along the line 4—4 of FIG. 3 looking in the direction of the arrows.
Figure 3:
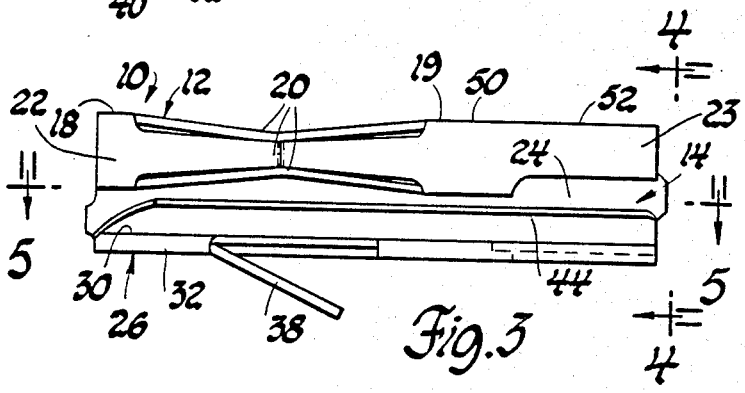
FIG. 3 is a side view of the electrical terminal shown in FIG. 2.

The elongated web 24 has a flange 26 integrally joined thereto at a longitudinal edge which is spaced from the resilient socket 12. The flange 26 is stamped as shown in FIG. 1 and folded back into itself to form an elongated outer plate 28 and an elongated inner plate 30 which are integrally joined to each other at one end of the flange 26 by a longitudinal bight or reverse fold 32 as best shown in FIG. 2.

At the opposite end of the flange 26, the elongated outer plate 28 has a narrow longitudinal slot 34 provided with a flared opening 36 for guiding the insulated conductor 16 into the narrow slot 34. The width of the narrow slot 34 is less than the outer diameter of the insulated conductor 16 and preferably less than the diameter of the conductor core 17. However, the width of the narrow slot 34 relative to the diameter of the conductor core 17 is not critical because of the shear action of the elongated inner plate 30.

As shown in FIG. 1, the middle portion of the outer plate 28 is stamped to provide a latch tang 38 which is bent out of the plane of the outer plate 28 when the terminal 10 is formed as shown in the remaining figures.

The elongated inner plate 30 also has a longitudinal slot 40 at the opposite end of the flange 26. The longitudinal slot 40 is likewise provided with a flared opening 42. The inner plate 30 has a cut 31 which extends from the inner end of the slot 40 to the cut-out for the latch tang 38 as shown in FIG. 1 so that the active portion of the inner plate 30 is joined to the outer plate 28 solely by the longitudinal bight 32 when the flange 26 is folded back onto itself.

The inner longitudinal side of the elongated inner plate has a curled lip 44 which engages the web 24.

Figure 5:
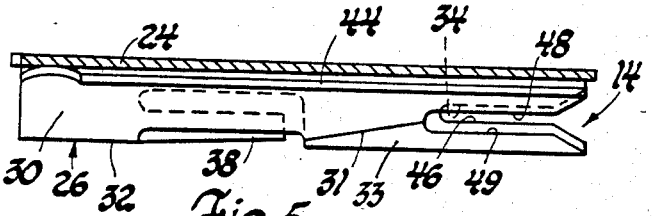
FIG. 5 is a longitudinal section of the electrical terminal taken substantially along the line 5—5 of FIG. 3 looking in the direction of the arrows.

When the inner plate 30 is folded over onto the outer plate 28, the longitudinal slots 32 and 40 are laterally offset from each other and overlap as shown in FIG. 5. The plates 28 and 30 thus form a common conductor receiving slot defined by the longitudinal side 46 of narrow slot 34 in outer plate 28 and the longitudinal side 48 of the slot 40 in the inner plate 30. Since the opposite longitudinal side 49 of the slot 40 is on an inactive portion 33 of the inner plate 30, the width of the longitudinal slot 40 is not critical and in some instances the inactive portion 33 may be removed.

The web 24 and the elongated plates 28 and 30 of the flange 26 are used to attach the terminal 10 to the insulated conductor 16 so as to shear the insulation and make electrical contact with the conductive core 17.

In addition, the terminal 10 may also have a strain relief provided by an extension 50 of the rearward end band 19. This extension comprises a plate 52 which is parallel to and laterally spaced from the slotted end of the flange 26 and which has a longitudinal slot 54 provided with a flared opening 56. The width of the slot 54 is sufficiently less than the outer diameter of the insulated conductor 16 so that it is tightly gripped in the slot 54 and held in position to strain relieve the electrical connection made by the plates 28 and 30 with the conductive core 17.

Figure 7:
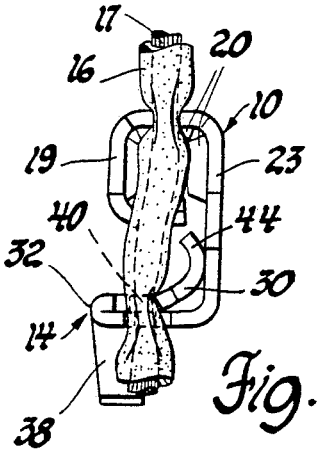
FIG. 7 is a rear view of the electrical terminal and insulated conductor taken substantially along the line 7—7 of FIG. 6 looking in the direction of the arrows.
Figure 6:
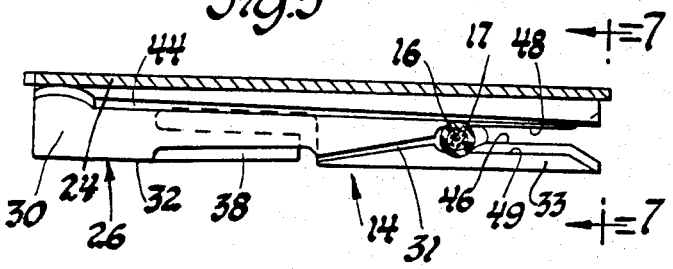
FIG. 6 is a longitudinal section showing the electrical terminal attached to an insulated conductor.

The electrical terminal 10 is attached simply by moving the insulated conductor 16 transversely to its axis into the slots 34, 40 and 54. As the insulated conductor 16 enters the common slot formed by the longitudinal sides 46 and 48, the inner plate 30 is pushed toward the web 24 and twists like a torque arm while the curled lip 44 engages and rides up the web 24 as shown in FIGS. 6 and 7. The active portion of the inner plate 30 thus constantly exerts a force on the insulated conductor 16 which produces a shearing action of the longitudinal sides 46 and 48 against the insulated conductor 16 across its diameter. This arrangement enhances the insulation piercing characteristics of the terminal as well as the electrical interface with the conductive core 17. The size and treatment of the slot 34 is not critical as in fixed slot designs and the terminal is particularly useful for insulated conductors having multistranded conductive cores which tend to change in size and shape during use. It should also be noted that the arrangement is very compact particularly with regard to the width of the electrical terminal 10 best illustrated in FIGS. 4 and 7. This narrow arrangement permits several electrical terminals 10 to be placed side-by-side so that the resilient sockets 12 are on close centerlines.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An insulating shearing electrical terminal for terminating an insulated conductor comprising;

a web having a flange integrally joined thereto at a longitudinal edge, said flange being folded over onto itself to form outer and inner elongated plates which are integrally joined to each other at one end by a longitudinal bight which is laterally spaced from the web, said outer plate having a longitudinal slot at the opposite end of the flange for receiving an insulated conductor with its axis transverse to the longitudinal slot, and said inner plate having an inner longitudinal side slidably engaging the web and an outer longitudinal side at the opposite end which overlaps the longitudinal slot in the outer plate for biasing the insulated conductor against the longitudinal side of the longitudinal slot of the outer plate which is remote from the web.

2. An insulation shearing electrical terminal for terminating an insulated conductor comprising;

a web having a flange integrally joined thereto at a longitudinal edge, said flange being folded over onto itself to form outer and inner elongated plates which are integrally joined to each other at one end by a longitudinal bight which is laterally spaced from the web, said outer plate having a longitudinal slot at the opposite end of the flange for receiving an insulated conductor with its axis transverse to the longitudinal slot, said inner plate having an outer longitudinal side at the opposite end of the flange which is closer to the web than the longitudinal side of the longitudinal slot of the outer plate which is further from the web so that the longitudinal side of the inner plate engages an insulated conductor wire received in the longitudinal slot of the outer plate and twists the inner plate, and said inner plate having a curled lip at its inner longitudinal side which engages and rides up the web when the inner plate is twisted.

* * * * *